US007603867B2

(12) United States Patent
Brown

(10) Patent No.: US 7,603,867 B2
(45) Date of Patent: Oct. 20, 2009

(54) PROCESS AND SYSTEM TO PRODUCE MULTIPLE DISTRIBUTABLE PRODUCTS FROM SOURCE, OR IMPORTED LNG

(75) Inventor: Ross M. Brown, Escondido, CA (US)

(73) Assignee: Cryogenic Group, Inc., Murrieta, CA (US)

( * ) Notice: Subject to any disclaimer, the term of this patent is extended or adjusted under 35 U.S.C. 154(b) by 450 days.

(21) Appl. No.: 11/518,626

(22) Filed: Sep. 11, 2006

(65) Prior Publication Data

US 2008/0060380 A1 Mar. 13, 2008

(51) Int. Cl.
*F25J 3/00* (2006.01)
*F17C 9/02* (2006.01)

(52) U.S. Cl. ..... 62/50.2; 62/620

(58) Field of Classification Search ..... 62/50.2, 62/620

See application file for complete search history.

(56) References Cited

U.S. PATENT DOCUMENTS 3,420,068 A * 1/1969 Petit Pierre ..... 62/623
3,837,172 A 9/1974 Markbreiter et al
5,114,451 A 5/1992 Rambo et al.
5,359,856 A 11/1994 Rhoades et al.
6,564,579 B1 5/2003 McCartney
6,604,380 B1 8/2003 Reddick et al.
6,907,752 B2 6/2005 Schroeder et al.
7,278,281 B2 * 10/2007 Yang et al. ..... 62/612
7,310,972 B2 * 12/2007 Yoshida et al. ..... 62/620
2006/0042312 A1 * 3/2006 Winningham ..... 62/620
2006/0277943 A1 * 12/2006 Yokohata et al. ..... 62/620
2007/0204651 A1 * 9/2007 Nanda ..... 62/620

* cited by examiner

*Primary Examiner*—William C Doerrler
(74) *Attorney, Agent, or Firm*—William W. Haefliger

(57) ABSTRACT

The process that includes providing the following elements for treating source refrigerated LNG, a heat exchanger/condenser through which refrigerated LNG passes, a vaporizer receiving LNG from the heat exchanger/condenser to produce heating grade LNG product, a distillation column producing distillate condensed in the heat exchanger/condenser to produce vehicle grade LNG, some of which is returned to the distillation column, the distillation column having input of refrigerated LNG, the distillation column having a lower outlet through which produced C2+ is delivered.

8 Claims, 1 Drawing Sheet

Figure 1:
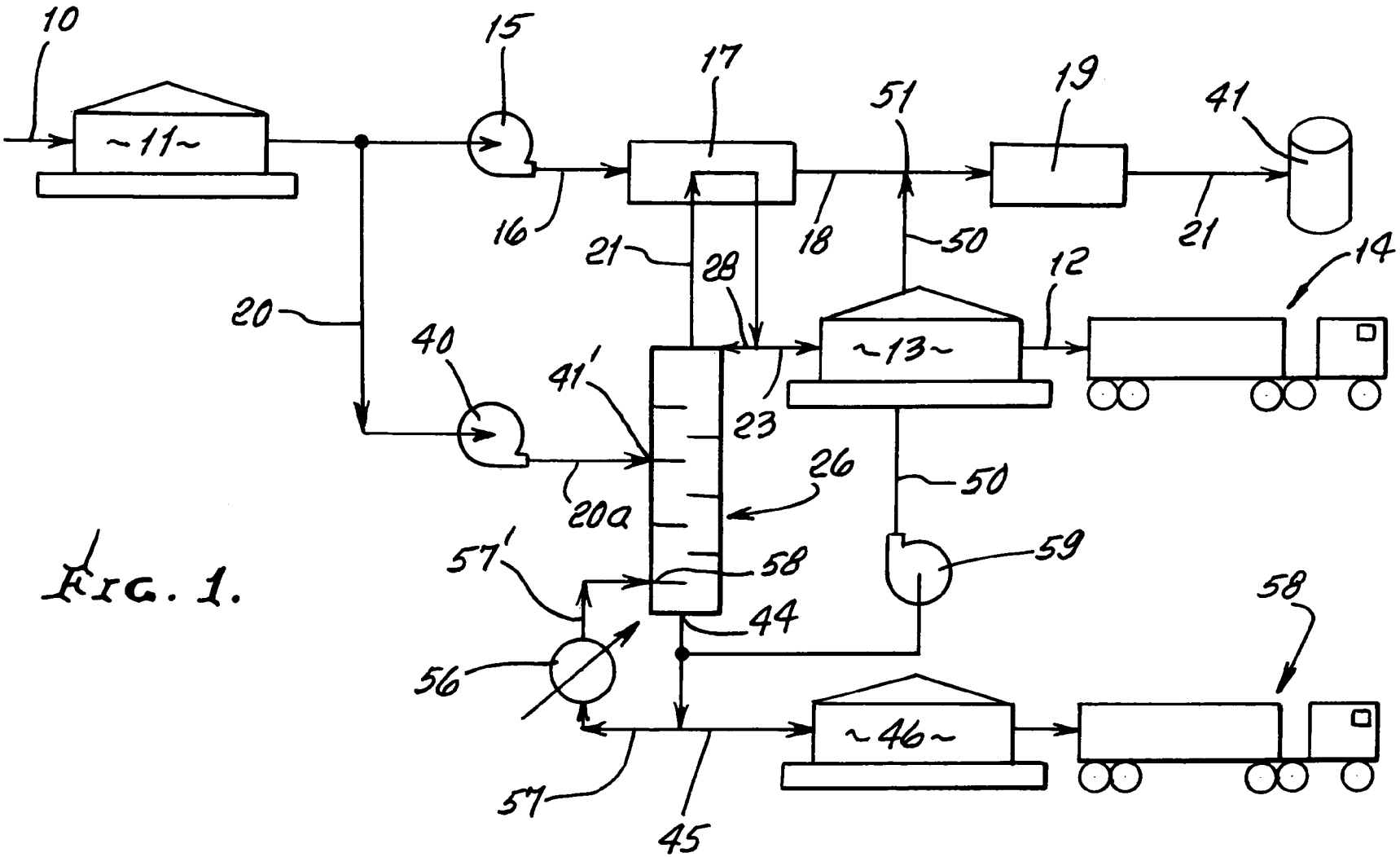

PROCESS AND SYSTEM TO PRODUCE MULTIPLE DISTRIBUTABLE PRODUCTS FROM SOURCE, OR IMPORTED LNG

BACKGROUND OF THE INVENTION

This invention relates generally to treatment of import grade liquefied natural gas (LNG) for uses in addition to formation and distribution of natural gas for commercial purpose. More specifically, it concerns such treatment to form engine fuel grade LNG, and/or to produce commercially distributable gas at elevated pressure.

Liquefied natural gas (LNG) is typically transported by ship to provide fuel in areas where there is insufficient indigenous natural gas. Once unloaded from the ship, it is stored in large storage tanks and then pumped and heated prior to being injected in gaseous state into a distribution pipeline. The primary end use for the natural gas is as fuel, where the exact chemical composition is of little concern.

There is however, an alternate use for LNG as a motor vehicle fuel where the LNG is carried on the vehicle in liquid form and, after conversion to warm gas, is combusted in an engine. Engines cannot tolerate many of the compounds frequently found in raw LNG, as they cause pre-ignition. High concentrations of many compounds, such as ethane, preclude normal LNG from being used as motor fuel.

It is possible to process LNG (heating grade) into LNG (vehicle engine fuel grade) by removing the undesirable compounds. See in this regard U.S. Pat. No. 6,986,266. One characteristic of conversion methods is the requirement for refrigeration. This raises both the capital cost and operating cost.

SUMMARY OF THE INVENTION

Large LNG receiving and send-out terminals present a unique opportunity to use already available LNG refrigeration, as well as pressurization. The present invention involves use of the refrigeration of the LNG being pumped and sent out (injected into a pipeline) to provide refrigeration necessary to convert a portion of the stream into a more purified stream of LNG (vehicle grade).

The invention also concerns provision of a system or process in which the following elements are provided for treating source refrigerated LNG:

a) a heat exchanger/condenser through which refrigerated LNG passes, b) a vaporizer receiving LNG from the heat exchanger/condenser to produce heating grade LNG product, c) a distillation column producing distillate condensed in the heat exchanger/condenser to produce vehicle grade LNG, some of which is returned to the distillation column, d) the distillation column receiving input of refrigerated LNG, e) the distillation column having a lower outlet through which produced C2+ is delivered.

The system provides a simple method for producing vehicle grade LNG from imported LNG, using the refrigeration from the send out of heating grade LNG to distribution.

Additional objectives include 1) providing s secondary heater vaporizer receiving product from a lower portion of the distillation column and returning product to a lower portion of the column;

2) delivering LNG product to a pipeline grid; delivering condensed vehicle grade LNG to both the distillation column and to a storage or transport facility; and delivering C2+ product from the bottom of the distillation column to a storage or transport facility;

3) pumping a first portion of source LNG to elevated pressure level for passage to the heat exchanger/condenser for heat exchange with said distillate column produced distillate condensed in the heat exchanger/condenser to produce vehicle grade LNG, some of which is returned to the distillation column, 4) pumping a second portion of source LNG to elevated pressure for passage to the distillation column for distillation.

These and other objects and advantages of the invention, as well as the details of an illustrative embodiment, will be more fully understood from the following specification and drawings, in which:

DRAWING DESCRIPTION

FIG. 1 is a diagram showing a preferred form of the invention.

DETAILED DESCRIPTION

In FIG. 1, the preferred form of the invention, heating grade source LNG, supplied at 10 as from a ship or transport vessel, is stored at 11, as imported LNG. It is desired that vehicle engine grade LNG be derived from the LNG stored at 11, and supplied for commercial purposes as at 12, as for example from storage at 13. A commercial transport vehicle is shown at 14 receiving the vehicle grade LNG.

The refrigerated heating grade LNG supplied at 20 as from storage 11 is pumped by main send out pump at 15 for delivery at 16 to heat exchanger/condenser apparatus 17, from which it flows at 18 to a vaporizer 19. The pump elevates the LNG to pipeline pressure, typically 50 to 100 atmospheres; and the vaporizer operates to heat the cold LNG to warm temperature, typically 10 to 20 degrees Centigrade, for conversion to gas. The gasified LNG is then delivered at 21 to a commercial pipeline 41, as HGLNG (heating grade LNG).

The process utilizes the "cold" containing in the LNG stream 20 to provide refrigeration to a distillation column 26 operating to purify the LNG to vehicle grade (typically 99% methane). A secondary pump 40 receives cold LNG stream **20*a*, and delivers it to a mid-point 41'** of column, as for example at about 7 bara. The column pressure may vary over a broad range, from about 4 bara to the critical point of methane.

The liquid LNG flowing through one side of the exchanger 17 is heated slightly (typically from 115 degK to 120 degK). The other side involves condensing a near pure methane gas stream 21 from column 26 at a higher than atmospheric pressure (typically 7 to 14 atm). Most of the condensed methane is delivered at 28 (for flow by gravity or pumping) to the top of the distillation column 26 as reflux.

The remainder of the condensed methane is delivered at 23 to VGLNG (vehicle grade LNG) storage 13, from which that product is controllably delivered at 12 to transport vehicles 14 for distribution to fuel stations for vehicles.

The distillation column 26 has a lower outlet 44, through which bottoms product such as C2+ is delivered at 45 to C2+ storage 46, and transport at 58 where C2+ constitutes a liquid hydrocarbon stream containing ethane and heavier hydrocarbon components.

The C2+ product may be refined into nearly pure ethane and a C3+ bottoms hydrocarbon. As an alternative arrangement, the C2+ stream can be delivered at 50 for combination with the HGLNG stream at point 51, for processing in vaporizer 19 and delivery to pipeline.

Also shown is a secondary heater vaporizer 56 receiving product (such as C2+) via stream 57 from a lower portion of the column 26, for returning lighter product (such as remanent methane), and bottoms, at 57 to the column at 58.

Accordingly, the invention provides a simpler, efficient method for producing three distributable products (HGLNG, VGLNG, C2+) from imported refrigerated LNG.

I claim:

1. The process that includes providing the following elements for treating source refrigerated LNG:

a) a heat exchanger/condenser through which refrigerated LNG passes, b) a vaporizer receiving LNG from the heat exchanger/condenser to produce heating grade LNG product, c) a distillation column producing distillate condensed in the heat exchanger/condenser to produce vehicle grade LNG, the column having an upper outlet to pass near pure methane gas to the condenser from which said vehicle grade LNG is delivered to storage, and from which condensate is returned to the column, there being means to deliver at least some of the vehicle grade LNG to mix with LNG flowing to the vaporizer, d) the distillation column having input of refrigerated LNG from said source, e) the distillation column having a lower outlet through which produced C2+ is delivered, f) said column input located at a mid-region of the column above said column lower outlet.

2. The process of claim 1 including a secondary heater vaporizer receiving product from a lower portion of the distillation column and returning product to a lower portion of the column.

3. The process of claim 1 wherein said C2+ product consists of ethane and heavier hydrocarbons.

4. The process of claim 1 wherein said LNG product is delivered to a pipeline grid said vehicle grade LNG not returned to the column is delivered to a transport facility said C2+ product is delivered to another transport facility.

5. The process of claim 1 which includes pumping a first portion of said source LNG to elevated pressure level for passage to the heat exchanger/condenser for heat exchange with said distillate, condensed in the heat exchanger/condenser to produce vehicle grade LNG, some of which is returned to the distillation column.

6. The process of claim 5 which includes pumping a second portion of said source LNG to elevated pressure for passage to the distillation column, receiving input of refrigerated LNG.

7. The process of claim 1 wherein said source LNG is imported via a transport vessel, as refrigerated LNG.

8. The process of claim 1 wherein substantially all of the source refrigerated LNG that is passed to the column enters the column at said input at about 7 Bara.

* * * * *